US010335619B2

(12) United States Patent
Colorado

(10) Patent No.: US 10,335,619 B2
(45) Date of Patent: Jul. 2, 2019

(54) FIREFIGHTER MULTIFUNCTION LADDER AND ESCAPE BELT

(71) Applicant: FIRE INNOVATIONS LLC, Petaluma, CA (US)

(72) Inventor: Juancarlos Colorado, Petaluma, CA (US)

(73) Assignee: Fire Innovations LLC, Petaluma, CA (US)

( * ) Notice: Subject to any disclaimer, the term of this patent is extended or adjusted under 35 U.S.C. 154(b) by 63 days.

(21) Appl. No.: 15/533,975

(22) PCT Filed: Dec. 8, 2015

(86) PCT No.: PCT/US2015/064546

§ 371 (c)(1),
(2) Date: Jun. 7, 2017

(87) PCT Pub. No.: WO2016/094437

PCT Pub. Date: Jun. 16, 2016

(65) Prior Publication Data

US 2017/0368388 A1 Dec. 28, 2017

Related U.S. Application Data

(60) Provisional application No. 62/089,168, filed on Dec. 8, 2014.

(51) Int. Cl.
*A62B 35/04* (2006.01)
*A62B 35/00* (2006.01)

(52) U.S. Cl.
CPC ..... *A62B 35/04* (2013.01); *A62B 35/0037* (2013.01); *A62B 35/0006* (2013.01)

(58) Field of Classification Search
None
See application file for complete search history.

(56) References Cited

U.S. PATENT DOCUMENTS

| | | | | |
|---|---|---|---|---|
| 3,738,449 A | | 6/1973 | Arancio | |
| 4,387,911 A | * | 6/1983 | Takada | B60R 22/16 280/802 |
| 4,618,026 A | * | 10/1986 | Olson | A62B 35/04 182/4 |
| 4,854,608 A | * | 8/1989 | Barral | B60R 22/16 280/805 |

(Continued)

FOREIGN PATENT DOCUMENTS

| | | | | |
|---|---|---|---|---|
| CA | 2752418 A1 | * | 3/2012 | A62B 35/04 |
| EP | 2687268 A2 | * | 1/2014 | A62B 35/04 |
| WO | WO-2017116603 A1 | * | 7/2017 | A62B 35/0025 |

*Primary Examiner* — Marcus Menezes
(74) *Attorney, Agent, or Firm* — Craig M. Stainbrook; Stainbrook & Stainbrook, LLP

(57) ABSTRACT

A multifunction NFPA escape and ladder belt having multiple functions for firefighter and rescue worker work. The belt includes a front buckle and right and left side buckles, straps coupling the left and right side buckles to the front buckle and to one another. At least one of said straps includes a stitched loop portion formed with a stitching pattern configured to fail, and for the loop portion to unfold, when the side straps are under a sufficient tension load exceeding the breaking strength of the stitching pattern; that failure will occur before a structural failure in any other element or component of the belt.

14 Claims, 2 Drawing Sheets

(56) References Cited

U.S. PATENT DOCUMENTS

| | | | | |
|---|---|---|---|---|
| 6,732,834 | B2 * | 5/2004 | Colorado | A62B 35/0031 182/3 |
| 8,235,173 | B2 * | 8/2012 | Kopp | A45F 3/14 182/3 |
| 2002/0074185 | A1 | 6/2002 | Colorado | |
| 2004/0128734 | A1 * | 7/2004 | Jordan | A41D 13/0007 2/69 |
| 2006/0195962 | A1 * | 9/2006 | Jordan | A41D 13/0007 2/69 |
| 2012/0292129 | A1 * | 11/2012 | Seman | A62B 35/0006 182/9 |
| 2015/0231425 | A1 * | 8/2015 | Krueger | A62B 35/04 182/3 |

* cited by examiner

FIREFIGHTER MULTIFUNCTION LADDER AND ESCAPE BELT

BACKGROUND OF THE INVENTION

Technical Field

The present invention relates generally related to climbing and personal safety harnesses, and more particularly to a firefighter's combination escape and ladder belt.

Background Discussion

Firefighters and other first responders are routinely confronted with the danger of entrapment in burning buildings, some of which are multistory buildings. When rapid egress or escape is necessary, it is common for firefighters to use a rope and rappelling and descent equipment in connection with an emergency climbing harness to rappel to a safe level or to the ground. The harness assemblies generally include a waist belt. When falls are experienced during rapid descents, a waist belt having buckle and straps strengths sufficient to withstand forces from the fall may transmit those forces to the wearer, causing injury. Conversely, a waist belt having insufficient strap and buckle strengths that will fail under tension loads will allow a wearer to fall, likely causing serious injury or death.

It would be desirable, therefore, to provide a multifunction waist belt configured to withstand tension loads likely to be encountered in falls suffered in rapid egress situations, but also configured to absorb forces acting on the waist belt so as to prevent injurious forces from being transmitted to the wearer. The present invention provides such a belt.

DISCLOSURE OF INVENTION

The present invention is a certified National Fire Protection Association ("NFPA") 1983-2012 multi-function fire resistant escape belt. It is adapted for use with a multi-use strap of the kind described in U.S. Pat. No. 6,732,834, issued to the present inventor and incorporated in its entirety by reference herein. Use of the inventive escape belt with a multi-use strap enables the inventive belt and strap to function as an NFPA ladder strap, a one-leg harness, and various rapid intervention technology victim carry and drag systems.

It is therefore a principal object of the present invention to provide a new and improved NFPA escape and ladder belt having multiple functions for firefighter and rescue worker work.

It is another object of the present invention to provide a new and improved multi-purpose escape and ladder belt that is laterally agnostic (ambidextrous), providing rapid adjustment ability from either or both the right and left sides of the wearer using a double point forward pull adjustment.

A further object or feature of the present invention is a new and improved Kevlar material belt with an attachment point for bailout and connection to a ladder strap.

An even further object of the present invention is to provide a novel multi-purpose escape and ladder belt that adjusts from waist sizes ranging from 28 inches to 52 inches, wherein the belt is generally adapted for wearing on the outside of turnout gear.

A still further object of the present invention is to provide a new and improved firefighter's ladder and escape belt with various attachment points for adding accessories as needed, one at a time.

The foregoing summary broadly sets out the more important features of the present invention to facilitate a better understanding of the detailed description that follows, and so that the present contributions to the art may be better appreciated. There are additional features of the invention that will be described in the detailed description of the preferred embodiments of the invention which will form the subject matter of the claims submitted in a non-provisional patent application claiming the benefit of the filing date of the instant application.

BRIEF DESCRIPTION OF THE DRAWINGS

The invention will be better understood and objects other than those set forth above will become apparent when consideration is given to the following detailed description thereof. Such description makes reference to the annexed drawings wherein.

BEST MODE FOR CARRYING OUT THE INVENTION

Figure 1:
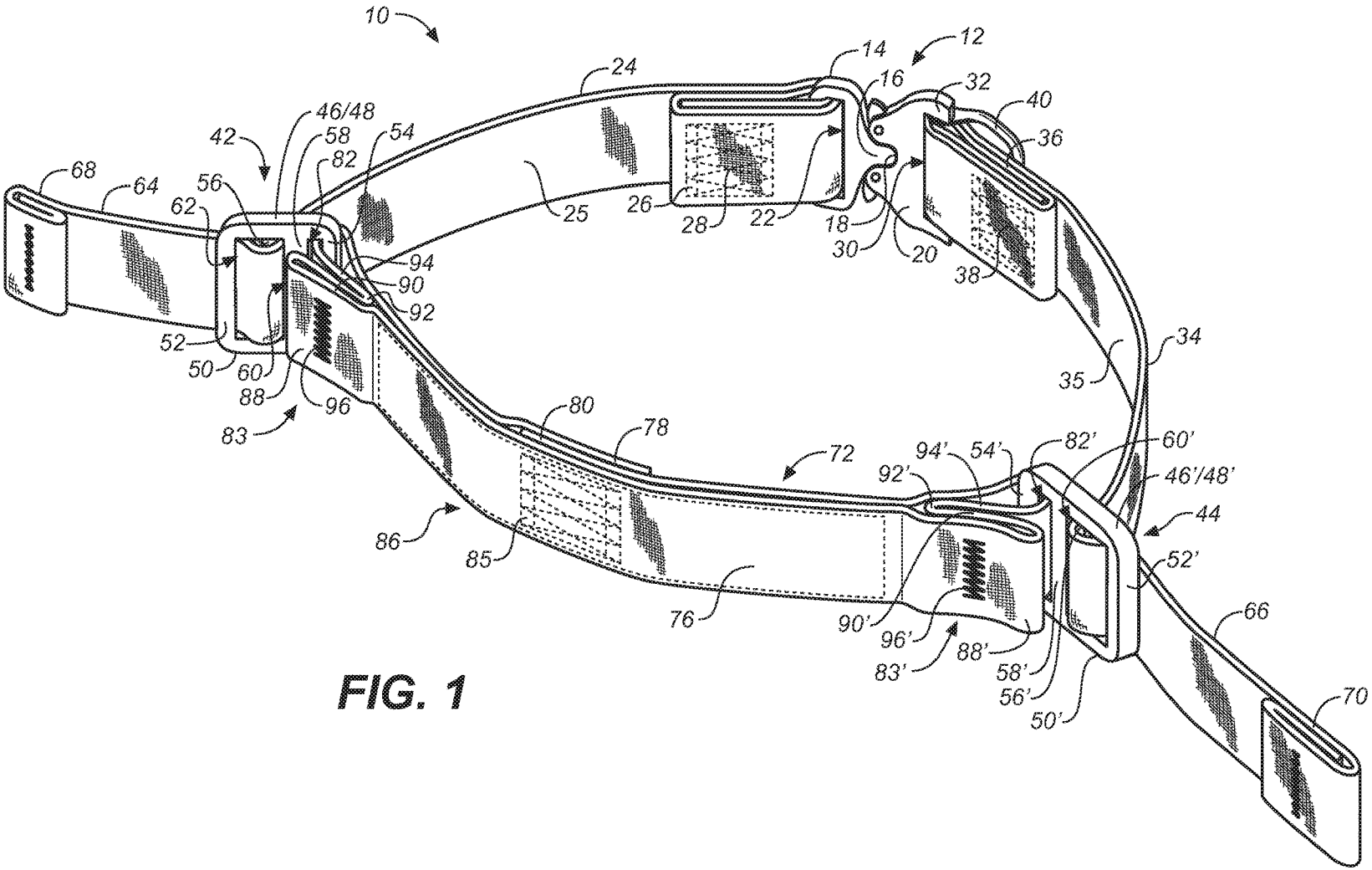
FIG. 1 is an upper front perspective view showing the inventive multipurpose firefighter's ladder and escape belt of the present invention.
Figure 2D:
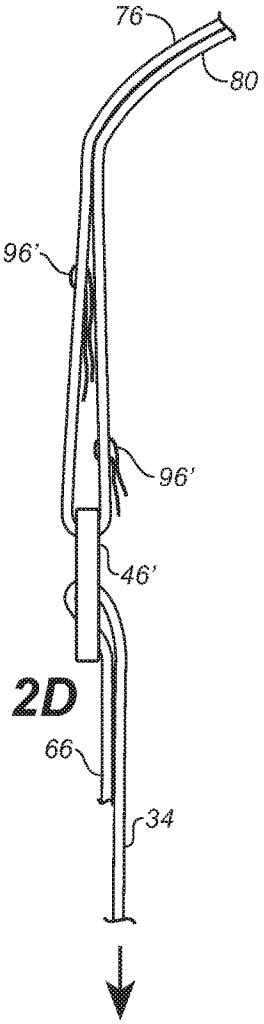
FIG. 2D is the same view showing the stitching after tensile failure.
Figure 2C:
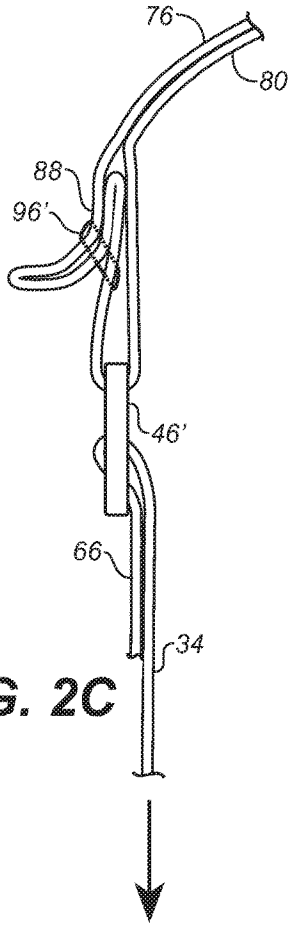
FIG. 2C is the same view showing the load continuing so as to place the stitching in the breakaway seam under increasing tension and approaching failure.
Figure 2B:
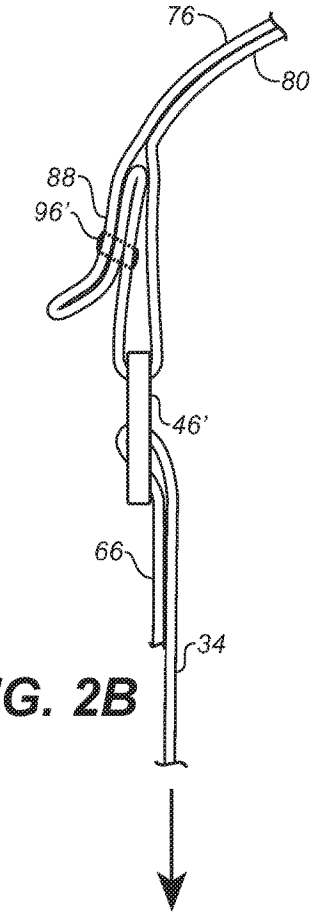
FIG. 2B is the same view showing a pulling load originating from the D-ring integrated into the front buckle and beginning to urge apart the combined folds in the breakaway seam.
Figure 2A:
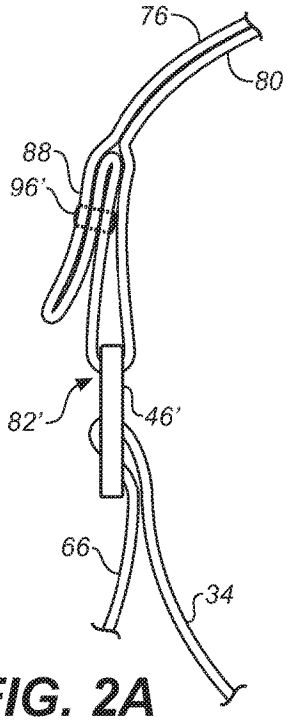
FIG. 2A is a partial right top plan view showing the bends and loops forming the configuration of the load-specific breakaway seam.

Referring to FIGS. 1 through 2D, wherein like reference numerals refer to like components in the various views, there is illustrated therein a new and improved multipurpose firefighter's ladder and escape belt, generally denominated 10 herein.

FIG. 1 illustrates an embodiment of the inventive belt, showing it in its most essential configuration as comprising a stab-lock type front buckle 12 having a male member 14 with a male element 16 insertable into the receptacle 18 of a female member 20. The male and female members may be either right or left portions of the buckle without any effect on belt function. The buckle will not open under load. The male member includes a slot 22 through which a first Kevlar webbing side strap 24 is passed and then folded back in a bend to form a four-layered loop portion 26 secured with Kevlar thread stitching 28 in an overlapping zig-zag joining stitch oriented horizontally with bordering vertically oriented double straight stitches (vertical bars), with an interior straight overcasting joining stitches vertically traversing the zig-zag overcasting stitch pattern, providing at least 600-800 pounds of tensile and shear load-bearing capacity. The female member includes identical structure, including a slot 30 defined by a strap connector and D-ring bar 32, through which slot and around which bar a second Kevlar side strap 34 is passed and then folded back in a bend to form a four-layered loop portion 36 secured with Kevlar thread stitching 38 also in an overlapping zig-zag joining stitch oriented horizontally with bordering vertically oriented double straight stitches (vertical bars), with an interior straight overcasting joining stitches vertically traversing the zig-zag overcasting stitch pattern. A stainless steel D-ring 40 is pivotally disposed on the D-ring bar 32 with its ends straddling the Kevlar side strap.

A suitable front buckle of the kind described above is manufactured by AustriAlpin of Blairmore, Alberta, Canada and is shown and described at http://www.austrialpin.net/products/cobra/. It is 1.75 inch/45 mm, 135 grams, and has a buckle strength rated at 18 kN/4,000 lb MBS (straight pull), 36 kN loop configuration, and the D-ring at 22 kN/5,000 lb MBS (straight pull). It is fabricated from 12 mm-7075 aluminum alloy and includes a stainless steel adjuster, rivets, components, and D-ring. The clips are brass.

First and second side straps 24, 34 (left and right, respectively) are connected to the male and female members of the front buckle in the manner indicated above. Creating the four-layered strap portions, 26, 36, entails feeding a length of strap back through the buckle slot 22, 30, folding the backfed portion in half and approximating it to the interior side 25, 35 of the side strap, and then introducing and passing the stitching 28, 38 through all four layers of strap material. After connection to the front buckle member, the first and second side straps are passed through first and second adjustment buckles 42, 44, respectively, each having a frame 46/46' with an upper frame bar 48/48', a lower frame bar 50/50', a front frame bar 52/52', a rear strap connector bar 54/54', a front medial bar 56/56', and a rear medial bar 58/58', collectively defining three slots. The side straps are threaded through middle adjustment slots 60/60', around front medial bars 56/56', through front adjustment slots 62/62', and under front frame bar 52/52', which is oriented anterior to the rear strap connector bar 54/54' when the belt is donned. In this configuration, each side strap 24, 34 includes a forwardly-disposed free end 64, 66, which preferably includes a portion of strap fabric 68, 70 folded back twice on itself and stitched so as to provide a built-up gripping portion for easy grasping by the wearer and preventing the strap ends from feeding back through the adjustment buckle. Tightening the belt then involves gripping each side strap by its gripping portion and pulling each side strap forward.

A rear strap 72 is provided, the rear strap having an outward facing continuous back portion (outer side) 76, first and second ends 78, 80, and load-absorbing energy-release double-loop portions 83/83'. The first and second ends 78, 80 are threaded through rear slots 82/82' of the adjustment buckles, but the double-loop portions are not, and are thus disposed behind the adjustment buckles. The first and second ends 78, 80 are overlapped on the inner side 77 of the rear strap and secured with stitching 85 in a three-layered medial portion 86.

The load-absorbing energy-release double-loop portions are also three layers thick, formed by two folds of the rear strap, a first forward fold 88/88' forming a medially directed loop portion 90/90', and a second forward fold 92/92' forming a laterally directed loop portion 94/94', after which the rear strap continues through the rear slots 82/82' of the adjustment buckles. The three layers of the load absorbing energy release double-loop portions are stitched with Kevlar thread in overcasting zig-zag and straight stitch patterns 96/96' as described above, and this strap connection provides an approximately 3,000 psi minimum breaking strength (~20.7 N/mm$^2$).

FIGS. 2A-2D show how the belt behaves if a wearer suffers a fall broken by a line coupled to the front D-ring. A tension is exerted on side strap 34 which transmits a combined tension and shear force to looped fabric strap member 88. Under near failure loads, the side adjustment buckles also slide to absorb energy and reduce shock to the wearer. When the force exceeds an amount at least exceeding the minimum breaking strength of the Kevlar stitching, because the breaking strength of each of the three-layered medial portion 86 and the four-layered strap portions, 26, 36, significantly exceed the breaking strength of the load-absorbing energy-release double look portions, the stitching will fail at the load-absorbing energy-release double-loop portions and the loops will unfold, all over time and after a portion of the force has been absorbed and the acceleration inducing the pull has been reduced. The D-ring connection to the escape rope is thereby protected and the wearer does not suffer a catastrophic fall due to total belt failure.

Note that attachment of a multi-use strap of the kind described in U.S. Pat. No. 6,732,834 (incorporated in its entirety by reference herein) enables the inventive belt to function as a ladder belt, an escape belt, or a rapid intervention victim carry/drag belt.

From the foregoing, it will be seen that in an essential aspect, the inventive apparatus is a multifunction NFPA escape and ladder belt having multiple functions for firefighter and rescue worker work. The belt includes a front buckle and right and left side buckles, straps coupling the left and right side buckles to the front buckle and to one another. At least one of the straps includes a stitched loop portion formed with a stitching pattern configured to fail, and for the loop portion to unfold, when the side straps are under a sufficient tension load exceeding the breaking strength of the stitching pattern; that failure will occur before a structural failure in any other element or component of the belt.

In another aspect, the inventive belt is seen to be a multifunction escape and ladder belt, comprising a front buckle having a first buckle member and a second buckle member, coupling apparatus to connect the first member to the second member, each of the first and second members having a slot through which a fabric side strap may be passed; left and right adjustment buckles, each configured with rigid bars defining front, middle, and rear slots through which strap fabric portions may be passed; left and right side straps connected at a first end to one of the first or second buckle members and a second end threaded through the middle adjustment slot of one of the first or second adjustment buckles, then through the front adjustment slot; and a rear strap having an outward facing continuous back portion, a first end threaded through the rear slot of the left adjustment buckle and extending to a medial portion of the rear strap, a second end threaded through the rear slot of the right adjustment buckle and extending to the medial portion of the rear strap, and first and second energy-release double-loop portions, one each formed in the rear strap proximate each of the left and right adjustment buckles forming an double-looped overlapping portion secured by stitching.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A multifunction escape and ladder belt, comprising:

a front buckle having a first buckle member and a second buckle member, coupling apparatus to connect said first member to said second member, each of said first and second members having a slot through which a fabric side strap may be passed;

left and right adjustment buckles, each configured with rigid bars defining front, middle, and rear adjustment slots through which strap fabric portions may be passed;

left and right side straps, said left side strap connected at a first end to said first buckle member and having a second end threaded through said middle adjustment slot of said left adjustment buckle, then through said front adjustment slot of said left adjustment buckle, and said right side strap connected at a first end to said second buckle member and having a second end threaded through said middle adjustment slot of said right adjustment buckle, then through said front adjustment slot of said right adjustment buckle; and a rear strap having an outward facing continuous back portion, a first end threaded through said rear slot of said left adjustment buckle and extending to a medial portion of said rear strap, a second end threaded through said rear slot of said right adjustment buckle and extending to said medial portion of said rear strap so as to put said first end and said second end in an overlapping configuration, and first and second energy-release double-loop portions, one of each formed in said rear strap proximate each of said left and right adjustment buckles forming a double-looped overlapping portion secured by stitching;

wherein said stitching forms a stitched strap connection having a predetermined minimum breaking strength.

2. The multifunction escape and ladder belt of claim 1, wherein said first and second ends of said rear strap are stitched to said medial portion and to one another in said overlapping configuration such that said medial portion is a three-layered medial portion secured with stitching.

3. The multifunction escape and ladder belt of claim 2, wherein said rear strap includes an inner side and an outer side, and said first and second ends of said rear strap form said three-layered medial portion on said inner side of said rear strap.

4. The multifunction escape and ladder belt of claim 1, wherein said first and second energy-releasing double-loop portions comprise three layers of said rear strap secured in a loop configuration by stitching.

5. The multifunction escape and ladder belt of claim 4, wherein said energy-release double-loop portions are formed by two folds of said rear strap.

6. The multifunction escape and ladder belt of claim 1, wherein said energy-release double-loop portions include a first forward fold forming a medially directed loop portion, and a second forward fold forming a laterally directed loop portion.

7. The multifunction escape and ladder belt of claim 6, wherein said first and second energy-release double-loop portions are stitched in a zig-zag stitch pattern.

8. The multifunction escape and ladder belt of claim 7, wherein said stitching is made from aramid fiber thread.

9. The multifunction escape and ladder belt of claim 7, wherein said stitching provides a stitched strap connection in said energy-release double-loop portions having a breaking strength of approximately 20.7 $N/mm^2$.

10. The multifunction escape and ladder belt of claim 1, wherein said stitched strap connection is configured to have a breaking strength such that said stitching in said stitched strap connection will fail under load before the connections of said left and right side straps to said first or second buckle members fail.

11. The multifunction escape and ladder belt of claim 10, wherein said left and right side straps each include a free end disposed through one of said left and right adjustment buckles and having a portion of strap fabric folded back on itself and stitched so as to provide a built-up gripping portion for easy grasping by a wearer and to prevent each of said right and left side straps from being pulled through said right and left adjustment buckle, respectively.

12. The multifunction escape and ladder belt of claim 1, wherein said first and second energy-release double-loop portions are formed with stitching that provides a double-loop connection having a predetermined breaking strength ensuring that under loads exceeding said predetermined breaking strength, said stitching in said stitched strap connections in said double-loop connections fail before any other structure in said belt.

13. The multifunction escape and ladder belt of claim 12, wherein said left and right adjustment buckles slide along said left and right side straps to absorb energy and reduce shock to a wearer when said right side strap and said left side strap are under loads near said predetermined breaking strength.

14. The multifunction escape and ladder belt of claim 13, wherein when a tension force on said left and right side straps exceeds an amount at least exceeding the predetermined breaking strength of said stitching, said stitching in said energy-release double-loop portions will fail and said energy-release double-loop portions will unfold after a portion of the force has been absorbed and the tension force has been reduced.

* * * * *